United States Patent [19]

Stewart et al.

[11] 4,311,201

[45] Jan. 19, 1982

[54] CORE SAMPLE ORIENTATION TOOL

[75] Inventors: Daniel R. Stewart, Empire; Joachim H. Heinicke, Golden, both of Colo.

[73] Assignee: AMAX Inc., Greenwich, Conn.

[21] Appl. No.: 137,636

[22] Filed: Apr. 7, 1980

[51] Int. Cl.[3] ..... E21B 25/16

[52] U.S. Cl. ..... 175/44; 33/308

[58] Field of Search ..... 175/44; 33/308, 311, 33/302, 313

[56] References Cited

U.S. PATENT DOCUMENTS

| | | | |
|---|---|---|---|
| 1,711,797 | 5/1929 | Koppl . | |
| 1,859,949 | 5/1932 | Zublin . | |
| 1,897,871 | 2/1933 | Straatman . | |
| 1,897,872 | 2/1933 | Straatman . | |
| 1,954,115 | 4/1938 | Allen . | |
| 2,011,979 | 8/1935 | Martienssen . | |
| 2,017,522 | 10/1935 | Bailey et al. . | |
| 2,080,978 | 5/1937 | Church . | |
| 2,140,097 | 12/1938 | Vacquier . | |
| 2,190,790 | 2/1940 | Humphreys . | |
| 2,203,730 | 6/1940 | Johnson . | |
| 2,489,566 | 11/1949 | Engle . | |
| 2,536,303 | 1/1951 | Miller . | |
| 2,580,510 | 1/1952 | Brady . | |
| 2,628,816 | 2/1953 | Mahan . | |
| 2,657,013 | 10/1953 | Brady . | |
| 2,670,179 | 2/1954 | Natland et al. . | |
| 2,709,069 | 5/1955 | Boucher . | |
| 2,735,652 | 2/1956 | Brady . | |
| 2,820,610 | 1/1958 | Martinez | 255/1.4 |
| 2,974,739 | 3/1961 | Dean | 175/2 |
| 3,059,707 | 10/1962 | Frisby | 175/44 |
| 3,115,196 | 12/1963 | Roxström | 175/44 |
| 3,183,983 | 5/1965 | Vogel | 175/44 |
| 3,207,239 | 9/1965 | Hügel et al. | 175/44 |
| 3,209,823 | 10/1965 | Winkel | 166/253 |
| 3,241,623 | 3/1966 | Martinez | 175/44 |
| 3,324,563 | 6/1967 | De Gast | 33/205.4 |
| 3,363,703 | 1/1968 | Shewmake | 175/44 |
| 3,450,216 | 6/1969 | Hügel et al. | 175/44 |
| 4,128,134 | 12/1978 | Gregory | 175/44 |
| 4,141,153 | 2/1979 | Nelson | 33/286 |

FOREIGN PATENT DOCUMENTS

| | | | |
|---|---|---|---|
| 318685 | 12/1971 | U.S.S.R. | 175/44 |

*Primary Examiner*—William F. Pate, III

*Attorney, Agent, or Firm*—Roland T. Bryan

[57] ABSTRACT

A core sample orientation tool for coupling to push rods or wire lines for use in obtaining core impressions in bore holes. The tool includes a putty cup and mark receiving surface which are removably attached to a sleeve housing a pendulum-oriented marker which marks the mark receiving surface when a core impression is taken to indicate a chosen directional reference. The removed putty cup and mark receiving surface can be used to orient a previously drilled core or the core to be drilled next, and when the core is laid out on a table in the proper up-down relationship, and considered in conjunction with bore hole logging techniques, the strike and dip of planar core features can be translated into actual attitudes in space.

22 Claims, 6 Drawing Figures

CORE SAMPLE ORIENTATION TOOL

BACKGROUND OF THE INVENTION

The present invention relates to bore hole tools, and more specifically to a core sample orientation tool used for taking core impressions in bore holes.

Core drilling is employed in various fields and particularly in the mining and petroleum industries in order to secure samples of the earth's crust at predetermined depths to secure subsurface geological data for the purpose of analysis and study. Full knowledge of the characteristics of a subsurface formation can be obtained only if the precise location and orientation of the core sample, before it was taken, can be determined. Core orientation is accomplished by removing a sample of the core from a bore hole and orienting it in space in precisely the same position that it occupied in the bore hole. Normally such orientation of core samples is done for the purpose of aiding in the proper evaluation of subsurface geology and thus determining the proper drilling program for the bore hole or well. A further purpose is to facilitate the proper development of an oil field by ascertaining the dip and strike of subsurface formations, such data being of considerable importance to the geologist. The dip of a stratum is the largest angle between the plane of the stratum and a horizontal plane. The strike of the stratum is the direction that the intersection of the plane of the stratum and a horizontal plane makes with respect to north.

Although data for determining dip and strike can be obtained by other methods, as for example, a comparison of several bore holes by electric logging and bore hole profile logging techniques, such methods rely on the difference in properties between the successive strata and are sometimes not applicable where massive bodies of rock are encountered. Hence, there is a need for orienting cores to obtain the fullest information when boring a bore hole or well.

During the drilling of a bore hole in the search for oil or minerals, core samples are cut from the formations being traversed and are removed to the earth's surface for examination. Various important information can be obtained from such a core. For example, if any bedding planes are observable in the core, the strike and dip of these planes (and hence of the formation from which the core was obtained) can be determined. The true directions of strike and dip, however, can be determined only if the core can be oriented (in space) in the same way that it was oriented in its original place in the formation.

In order to ascertain the dip and strike of strata existing underground, it is first of all necessary to sink a bore hole to intersect the stratum to be investigated and to extract a piece of bore core from the lower end of the bore hole. A bore hole of any considerable depth, however, always deviates from its original vertical direction so that readings taken from the piece of bore core when mounted in a vertical position will not correctly represent the dip and strike of the selected stratum.

Geologists have long recognized the value of oriented cores. The initial and most obvious use of oriented cores is to determine the dip and strike of inclined strata which permits a more complete interpretation of structural complications. Secondary recovery programs such as water flooding have also shown that it is highly desirable to know the extent and direction of any preferential permeability which formations may exhibit. The great mass of subsurface geological data obtained over the past several years in the concerted geologic research efforts of most oil companies have amplified the need for oriented subsurface data of every type. This potential is not restricted to the petroleum industry, but is equally applicable wherever drilling cores are obtained, such as in the exploration for development of uranium, metallics, non-metallics and other minerals, the engineering and construction of dam sites, tunnels, bridges and the like, quarrying operations and many others. However, this data is of use only when drilled cores are oriented with the utmost accuracy and then only when the orientation can be accomplished economically. Many devices, methods and techniques have been employed for accomplishing core orientation. Some are complicated and time-consuming, some are of limited accuracy, and others have not been entirely satisfactory for various reasons.

One known technique employs a magnetic needle which is held fixed in the position of core orientation. Another technique scribes a mark on the core itself. Another technique includes a marker driven into a hole in the core which remains there while the core is being drilled out and brought up to the surface. Another technique injects a charge of magnetically susceptible particles adjacent to the rock to be sampled. Another technique employs a luminous ball and a light-sensative surface. Another technique subjects the rock to be sampled to a strong magnetic field of known orientation before the core is taken so that after cutting, the original orientation of the core may be ascertained by making use of the remanent induced magnetism. Another technique compares the physical property of a side wall core of known orientation with a conventional core. Still another technique uses a pin carrier ring and movable ball to determine the orientation of the core at the bottom of a bore hole. Another technique uses an orientation indicating instrument which secures the core stub thereto.

It is also known to employ a pendulum which may oscillate in all directions relative to the middle axis of the core tube and having a borer at its end to directly mark the face of a core to determine the angle of inclination of dip, see U.S. Pat. No. 2,011,979 (Martienssen). This device suffers from the same problems as the other aforementioned devices that directly mark the core, i.e., debris, water or mud in the hole which may prevent suitable marking and a separate hole survey is needed to orient the core for each core sample.

Still another technique which is used by the Bureau of Reclamation employs a putty receptacle attached to aluminum or plastic manual setting tools. Once a drill hole has been started, a mark is made at twelve o'clock on the hole collar. Next, the putty receptacle is pushed into the hole with the setting tools, maintaining constant alignment between a scribe line on the tools and the mark on the hole collar. When hole bottom is reached, the putty is pressed against the bottom and an impression is made. The setting tools and putty impression are then removed from the hole. The putty receptacle is then placed in a tray in the configuration where the scribe line is in its uppermost position (twelve o'clock). When the next length of core is removed from the hole, it is placed in the tray and matched to the impression in the putty. The drill core can now be mapped for fracture orientations and spacings. This technique requires precise matching of the scribe lines by the operator and is limited to manual application in shallow holes, i.e., approximately 200 feet.

SUMMARY OF THE INVENTION

It is an object of the present invention to provide a core sample orientation tool that is highly reliable in determining core orientation.

It is a further object of the present invention to provide a core sample orientation tool that overcomes the disadvantages of the aforementioned known techniques.

It is a further object of the present invention to provide a core sample orientation tool for wire line applications, i.e., beyond the limits of manual operation.

It is a further object of the present invention to provide a core sample orientation tool which eliminates false markings due to accidental shocks during insertion of the tool into a bore hole.

It is a still further object of the present invention to provide a core sample orientation tool for orienting a previously drilled core or core to be drilled next.

It is a still further object of the present invention to provide a core sample orientation tool which enables the strike and dip of planar core features to be translated into actual attitude in space when combined with logging techniques.

Briefly, the core sample orientation tool of the present invention includes a sleeve having a putty cup and mark receiving member removably attached to the lower end of the sleeve and a pendulum-oriented marker slidably arranged within the sleeve to mark the mark receiving surface indicating a chosen directional reference of the core impression taken by the putty cup. Advantageously, hydraulic damping means may be employed, particularly in wire line applications, to control the downward movement of the pendulum-oriented marker allowing it to stabilize prior to marking the mark receiving member.

Other objects, aspects and advantages of the present invention will be apparent when the detailed description of the preferred embodiment of the invention is considered in conjunction with the drawings, which should be construed in an illustrative and not in a limiting sense, as follows:

DETAILED DESCRIPTION OF THE PREFERRED EMBODIMENT

Figure 1:
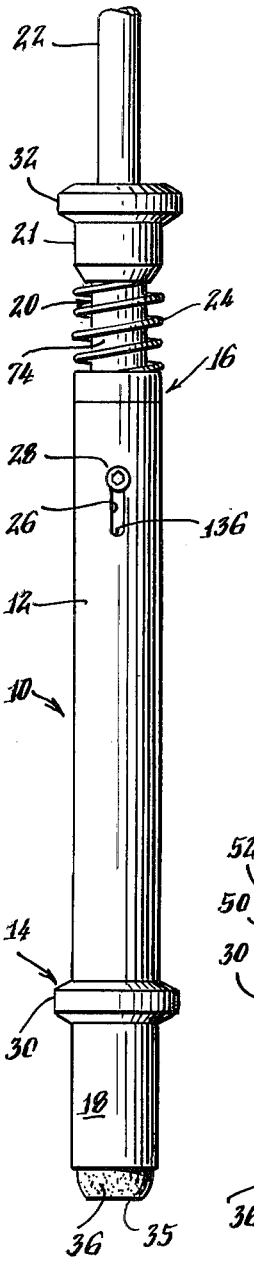
FIG. 1 is a side elevational view illustrating a manual core sample orientation tool in accordance with the present invention for coupling to a push rod bore hole extension member.

Referring to FIG. 1, a core sample orientation tool in accordance with the present invention is illustrated generally as 10. The core sample orientation tool includes an elongated body member or sleeve 12 with a lower end 14 and an upper end 16. A putty cup 18 is mechanically coupled to the lower end 14 of the elongated body member 12. A pendulum coupling member or tail piece 20 extends outwardly from the upper end 16 for mechanically coupling to tail mount 21 which is coupled to a bore hole extension member, here shown as a push rod 22. Preferably, the pendulum tail piece 20 includes a spring 24 concentrically mounted thereon, which will be described in more detail with reference to FIGS. 2 and 3. The elongate body member 12 also includes opposing slots 26 (only one of which is shown in FIG. 1) which receive projections shown as cap screws 28 (only one of which is shown in the drawing). The function of slots 26 and cap screws 28 will be described in more detail with reference to FIGS. 2 and 3.

Advantageously, the putty cup 18 and tail mount 21 include bushings 30 and 32, respectively, which serve as guide members and bearing surfaces as the tool 10 is lowered or raised through a bore hole or hollow drill bit in a bore hole, as desired.

Figure 2:
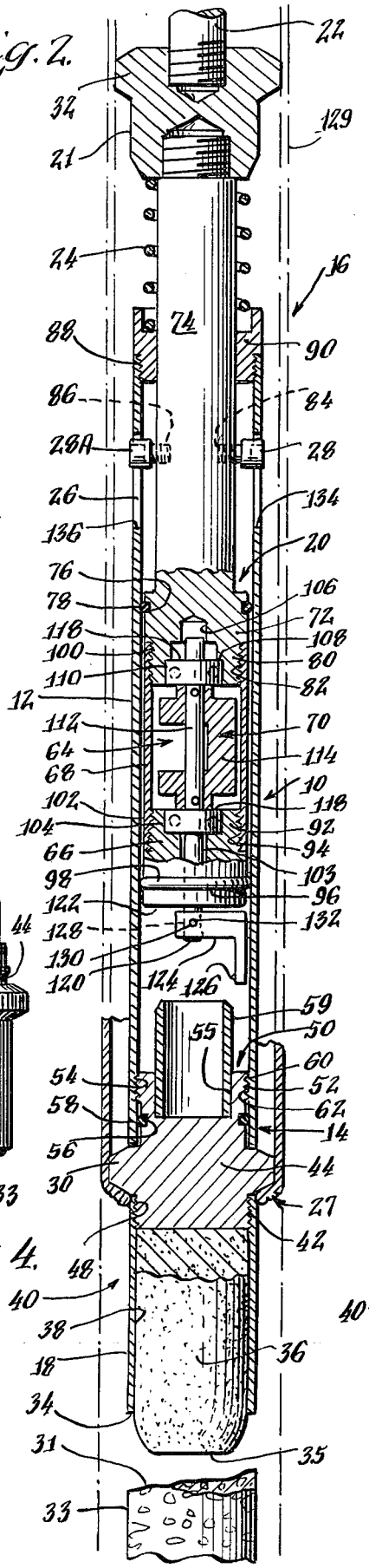
FIG. 2 is a partial cross-sectional view of the core sample orientation tool of FIG. 1 at the bottom of a bore hole before scribing.
Figure 3:
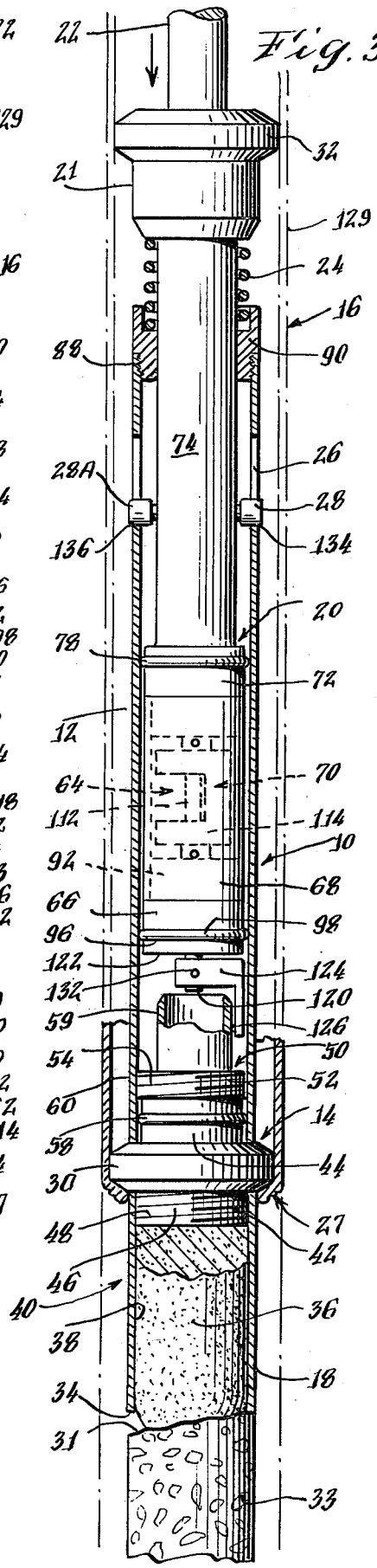
FIG. 3 is a partial cross-sectional view similar to FIG. 2, but with the scribe member in its down or collapsed position.

Referring to FIGS. 2 and 3, the putty cup 18 includes a blade end 34 for engaging a core. The putty cup 18 includes putty 36, and grooves (not shown) on its interior surface 38; the exposed surface 35 of the putty 36 is well oiled. The upper end 40 of the putty cup 18 opposite the blade end 34 includes circumferential threads 42. A plug member 44 having a lower threaded surface 46 with circumferential threads 48 mates with circumferential threads 42 of the putty cup 18. Circumferentially mounted about the plug member 44 is the bushing 30, preferably made of nylon. The plug member 44 includes an upper end 50. The upper end 50 includes upper threaded surface 52 with circumferential threads 54 arranged therein. Adjacent the lower ends of the threads 54 is an o-ring groove 56 for receiving an o-ring 58. The upper end 50 of the plug member 44 includes a recess 55 for receiving a mark receiving member shown as scribe receiving cylinder 59, preferably formed of plexiglass.

The elongate body member 10 includes a lower threaded portion 60 having circumferential threads 62 arranged therein. The circumferential threads 62 mate with threads 54 in the upper end 50 of the plug member 44 for removably coupling the putty cup 18 and scribe receiving cylinder 59 to the elongate body member 10.

Slidably and sealingly received within the elongate body member 10 is a pendulum assembly 64, preferably made of nonreactive material such as nylon or stainless steel, which includes the pendulum tail piece 20. The pendulum assembly 64 also includes a head piece 66 and intermediate tube 68 which connects the head piece 66 and tail piece 20 and which houses a pendulum 70. The tail piece 20 has an enlarged diameter portion 72 and a reduced diameter portion 74. The enlarged diameter portion 72 has an o-ring groove 76 to receive an o-ring 78. Adjacent the o-ring groove 76 is threaded surface 80 having circumferential threads 82 formed therein.

The reduced diameter portion 74 has threaded screw holes 84 and 86 to receive cap screws 28 and 28A, respectively. The reduced diameter portion 74 extends outwardly from the upper end 16 of the elongate body member 10 through a rear flange 90, preferably nylon, coupled to circumferential threads 88 on the interior surface of the upper end 16 of the elongate body member 10. The spring 24 concentrically mounted about the tail piece 20 extends between the rear flange 90 and the tail mount 21 and is biased to hold the pendulum assembly 64 in the upward position shown in FIG. 2.

The head piece 66 of the pendulum assembly 64 includes an upper surface 92 having circumferential threads 94 arranged therein. Adjacent to the circumferential threads 94 is an o-ring groove 96 for receiving an o-ring 98. The head piece 66 and tail piece 20 of the pendulum assembly are mechanically coupled together by the intermediate tube 68 to sealingly house the pendulum 70 therein. The intermediate tube 68 has upper and lower circumferential threads 100 and 102 formed on its interior surface for mating with threads 82 of the enlarged diameter portion 72 of the tail piece 20 and threads 94 of the head piece 66, respectively.

The head piece 66 also includes an axial bore 103 extending therethrough. A bearing recess 104 is formed in the head piece 66 at its upper end and concentric with the axial bore 103. The enlarged diameter portion 72 of the tail piece 20 includes an axial bore 106 extending therein at its lower end 108 with a bearing recess 110 formed therein concentric with the axial bore 106.

The pendulum 70 which is housed in the pendulum assembly 64 includes a shaft 112 with an eccentric weight 114 affixed thereto and bearings 116 and 118 mounted on the shaft 112 on opposite sides of the eccentric weight 114. The bearings 116 and 118 are received in bearing recesses 104 and 110, respectively. The bottom end 120 of the shaft 112 extends beyond the lower end 122 of the head piece 66. Fixedly coupled to the bottom end 120 of the shaft 112 is a marking member shown as a scribing bar 124 having a scriber 126 formed thereon. The scribing bar 124 includes a bore 128 therein to receive the bottom end 120 of the shaft 112. A tapped hole 130 is formed in the scribing bar 124 in communication with the bore 128 for receiving a set screw 132 to fixedly couple the scribing bar 124 to the shaft 112.

In operation, the manual core sample orientation tool 10 is coupled to the push rod 22 and inserted into a bore hole 129 here through a hollow drill rod and bit 27 in the bore hole 129. Manual operation is generally limited to bore holes having a depth of about 200 feet. At the end of the bore hole 129, the putty 36 receives an impression from the upper surface or face 31 of the core (rock) 33 whose orientation is desired. After a short time lapse to allow the pendulum 70 to rotate to a stable "bottom" position, which will occur in all off-vertical bore holes, a manual force applied to the push rods 22 telescopes or slides the pendulum assembly 64 downwardly within the elongate body member 10 allowing the scriber 126 to mark or scratch the tube 59 indicating the "down" directional reference, see FIG. 3. The downward movement and return of the pendulum assembly 64 within the elongate body member is limited by engagement of the cap screws 28 and 28A with the lower ends 134 and 136 of slots 26 and 138, respectively.

Figure 4:
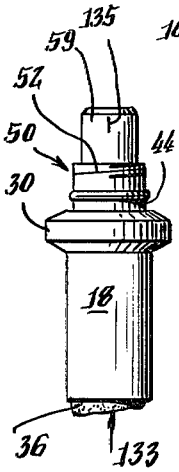
FIG. 4 is a side elevational view of the removable putty cup assembly of the core sample orientation tool.

As shown in FIG. 4, the putty cup 18, plug member 44, and scribe receiving cylinder 59 may be removed from the tool 10 after removal from the bore hole 129 and the scribe mark 135 on the scribe receiving cylinder 59 used to orient a previously drilled core or the core to be drilled next. The scribe mark 135 and the putty core impression 133 can be positioned in a tray in the predesigned attitude. When matched to the drill core, fracture orientation and spacings can be measured. Further, when hole survey data is available and the core is laid out on a table in its proper up-down relationship, the strike and dip of planar core features can be translated into actual attitude in space.

Figure 5:
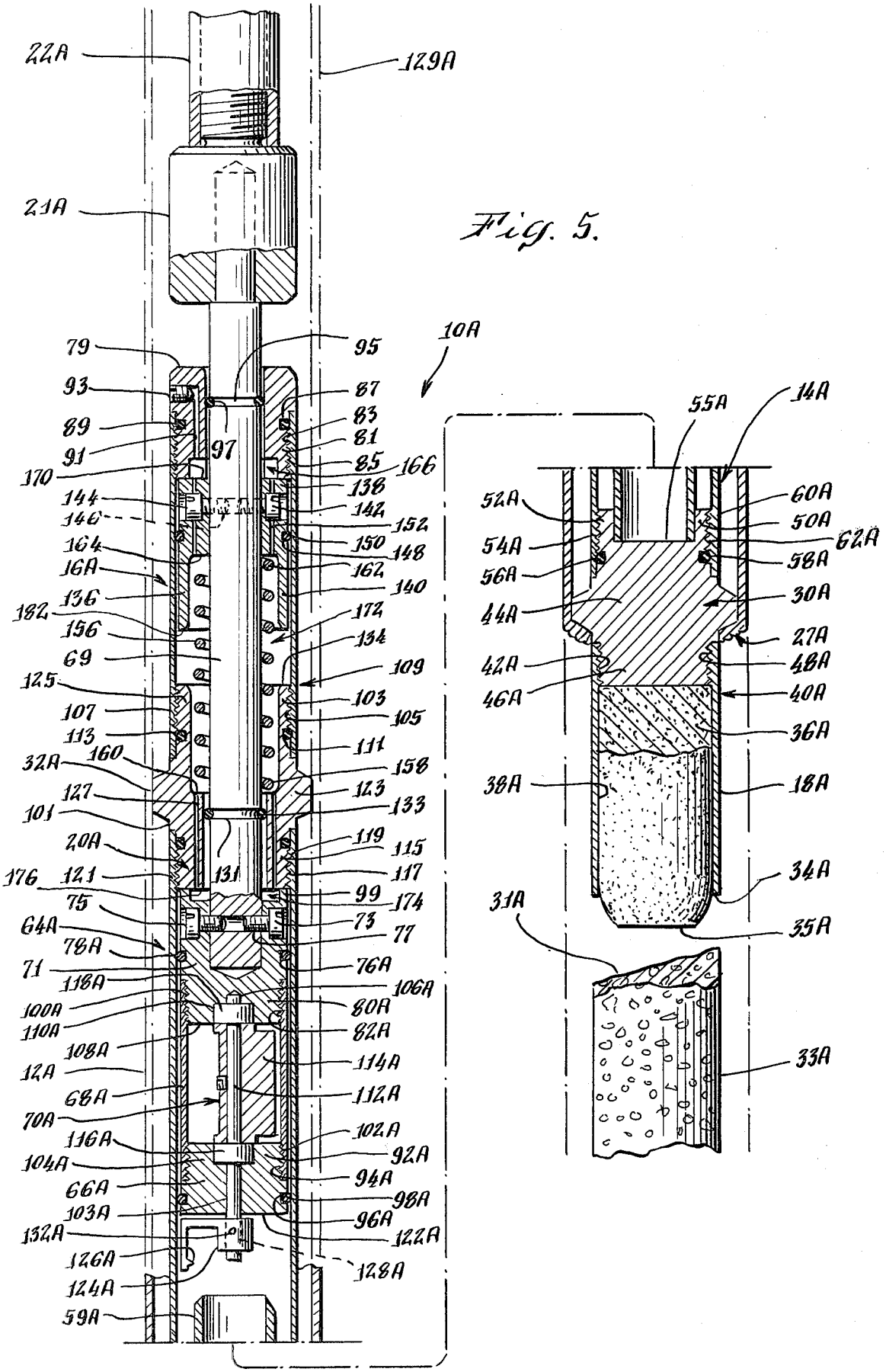
FIG. 5 is a partial cross-sectional view illustrating a wire line core sample orientation tool in accordance with the present invention at the bottom of a bore hole before scribing; the tool is capable of being coupled to an overshot and packer for up-hole use or an overshot and sinker bar for down-hole use.
Figure 6:
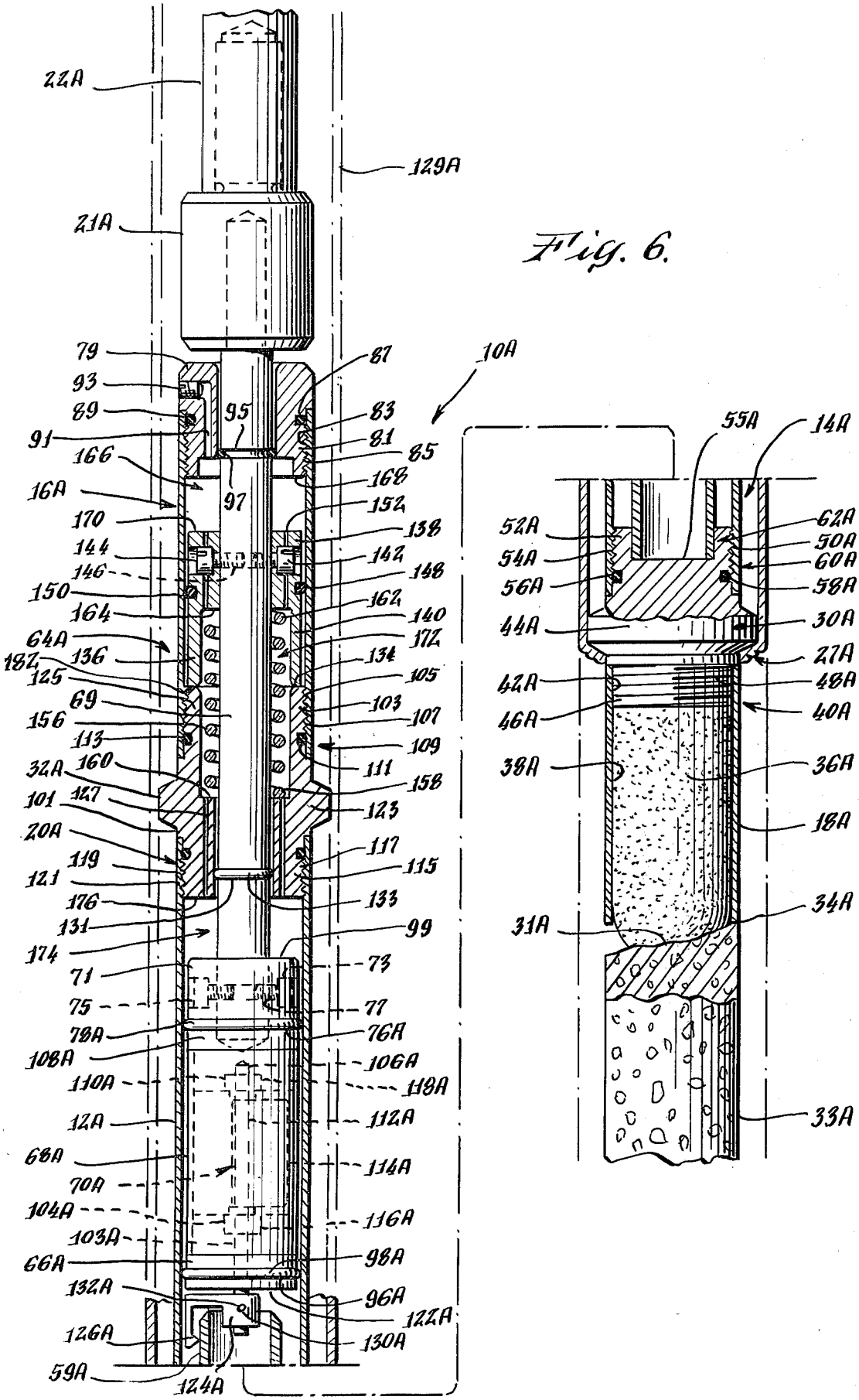
FIG. 6 is a partial cross-sectional view similar to FIG. 5, but with the scribe member in its down or collapsed position.

Referring to FIGS. 5 and 6, a wire line core sample orientation tool in accordance with the present invention is illustrated generally as 10A. The core sample orientation tool includes an elongate body member or sleeve 12A with a lower end 14A and an upper end 16A. A putty cup 18A is mechanically coupled to the lower end 14A of the elongate body member 12A. A pendulum coupling member or tail piece 20A extends outwardly from the upper end 16A for mechanically coupling to tail mount 21A which is coupled to a bore hole extension member, here shown as an overshot 22A. Advantageously, the putty cup 18A and tail mount 21A include bushings 30A and 32A, respectively, which serve as guide members and bearing surfaces where the tool 10A is lowered or raised through a hollow drill rod and bit 27A positioned in a bore hole 129A.

The putty cup 18A includes a blade end 34A for engaging a substrate. Preferably, the putty cup 18A includes putty 36A and grooves (not shown) on its interior surface 38A; the exposed surface 35A of the putty 36A is well oiled. The upper end 40A of the putty cup 18A opposite the blade end 34A includes circumferential threads 42A. A plug member 44A which includes a lower threaded surface 46A having circumferential threads 48A mates with threads 42A of the putty cup 18A. Circumferentially mounted about the plug member 44A is the bushing 30A, preferably made of nylon. The plug member 44A includes an upper end 50A remote from the lower threaded surface 46A. The upper end 40A includes upper threaded surface 52A with circumferential threads 54A arranged therein. Adjacent the lower ends of the threads 54A is an o-ring groove 56A for receiving an o-ring 58A. The upper end 50A of the plug member 44A includes a recess 55A for receiving a mark receiving member shown as a scribe receiving cylinder 59A hand press-fitted therein; the scribe receiving cylinder 59A is preferably of plexiglass.

The elongate body member 12A includes a lower threaded portion 60A having circumferential threads 62A arranged therein. The circumferential threads 62A mate with threads 54A in the upper end 50A of the plug member 44A for removable coupling of the putty cup 18A and scribe receiving cylinder 59A to the elongate body member 12A.

Slidably and sealingly received within the elongate body member 12A is a pendulum assembly 64A, preferably made of nonreactive material such as nylon or stainless steel, which includes the pendulum tail piece 20A. The pendulum assembly 64A also includes a head piece 66A and intermediate tube 68A which connects the head piece 66A and tail piece 20A and which houses a pendulum 70A.

The tail piece 20A includes a reduced diameter portion shown as a rod member 69 which is mechanically coupled to an enlarged diameter portion or front piece 71 via cap screws 73 and 75 received in transverse tapped hole 77 of the rod member 69. Front piece 71 has an o-ring groove 76A to receive an o-ring 78A. Adjacent the o-ring groove 76A is threaded surface 80A having circumferential threads 82A formed therein.

The rod member 69 extends outwardly from the upper end 16A of the elongate body member 10A through a rear mounting cap 79 mechanically coupled to the threaded upper end 16A of the elongate body member 12A. The rear mounting cap 79 includes a lower threaded surface 81 with threads 83 arranged therein for mating with circumferential threads 85 at the end 16A of the elongate body member 12A. Adjacent to the threaded surface 81 at the upper end is an o-ring groove 87 for receiving an o-ring 89. A hydraulic fluid fill hole 91 extends through the rear mounting cap 79 for communication with the interior of the elongate body member 12A and the exterior of the rear mounting cap 79. A set screw 93 seals the hydraulic fluid fill hole 91. The rod member 69 has an o-ring groove 95 for receiving an o-ring 97 which slides along a portion of the longitudinal extent of the rear mounting cap 79.

The head piece 66A of the pendulum assembly 64A includes an upper surface 92A having circumferential threads 94A arranged therein. Adjacent to the circumferential threads 94A is an o-ring groove 96A for receiving an o-ring 98A. The head piece 66A and front piece 71 of the tail piece 20A of the pendulum assembly are mechanically coupled together by the intermediate tube 68A to sealingly house the pendulum 70A. The intermediate tube 68A has upper circumferential threads 100A and lower circumferential threads 102A formed on its interior surface for mating with threads 82A of the front piece 71 of the tail piece 20A and threads 94A of the head piece 66A, respectively. The head piece 66A also includes an axial bore 103A extending therethrough. A bearing recess 104A is formed in the head piece 66A at its upper end and concentric with the axial bore 102A. The front piece 71 also includes an axial bore 106A extending therein at its lower end 108A with a bearing recess 110A formed therein concentric with the axial bore 106A.

The pendulum 70A which is housed in the pendulum assembly 64A includes a shaft 112A with an eccentric weight 114A affixed thereto and bearings 116A and 118A mounted on the shaft 112A on opposite sides of the eccentric weight. The bearings 116A and 118A are received in bearing recesses 104A and 110A, respectively.

The bottom end 120A of the shaft 112A extends beyond the lower end 122A of the head piece 66A. Fixedly coupled to the bottom end 120A of the shaft 112A is marking member shown as a scribe bar 124A having a scriber 126A formed thereon. The scribe bar 124A includes a bore 128A therein to receive the bottom end 120A of the shaft 112A. A tapped hole 130A is formed in the scribe bar 124A in communication with the bore 128A for receiving a set screw 132A to fixedly couple the scribe bar 124A to the shaft 112A.

Adjacent to the rear end 99 of the front piece 71 is a flange 101. The flange 101 has an upper threaded surface 103 with circumferential threads 105 on its exterior surface which mate with circumferential threads 107 on the interior surface of a rear portion 109 of the elongate body member 12A. Adjacent to the lower extent of the upper threaded surface 103 is an o-ring groove 111 for receiving an o-ring 113. The flange 101 also has a lower threaded surface 115 with circumferential threads 117 on its exterior surface which mate with circumferential threads 119 on the interior surface of the front portion 121 of the elongate body member 12A.

The flange 101 has an enlarged diameter portion 123 and reduced diameter portion 125. Flow passageways 127 extend longitudinally through the enlarged diameter portion 123. Arranged in the rod member 69 juxtaposed to the enlarged diameter portion 123 is an o-ring groove 131 for receiving an o-ring 133 for sliding movement of the rod member 69 relative to the enlarged diameter portion 123.

Spaced from the upper end 134 of the reduced diameter portion 125 of the flange 101 is a piston member 136. The piston member 136 includes an enlarged diameter portion 138 and a reduced diameter portion 140. The piston member 136 is fixedly coupled to the rod member 69 via cap screws 142 and 144 coupled to the enlarged diameter portion 138 and received in transverse tapped hole 146 of the rod member 69. Adjacent to the cap screws 142 and 144 and arranged in the exterior surface of the enlarged diameter portion 138 of the piston member 136 is an o-ring groove 148 for receiving an o-ring 150. Flow passageways 152 extend longitudinally through the enlarged diameter portion 138 of the piston member 136.

A spring 156 is concentrically mounted on rod member 69. One end 158 of the spring 156 abuts the stepped surface 160 formed between the enlarged diameter portion 123 and reduced diameter portion 125 of the flange 101. The other end 162 of the spring 156 abuts the stepped surface 164 formed between the enlarged diameter portion 138 and reduced diameter portion 140 of the piston member 136. The spring 156 is biased to normally maintain the pendulum assembly 64A in the position shown in FIG. 5 relative to the elongate body member 12A.

Further, hydraulic fluid, for example, oil, is introduced into the interior of the elongate body member 12A through the fill hole 91. With the pendulum assembly 64A in the position as shown in FIG. 5 within the elongate body member 12A, an upper chamber 166 is formed in the space between the lower end 168 of the rear mounting cap 79 and the juxtaposed upper end 170 of the piston member 136. Oil flows into the chamber 166 and then through passageways 152 to a main chamber 172 formed in the space between the reduced diameter portion 125 and stepped surface 160 of the flange 101 and the juxtaposed reduced diameter portion 140 and stepped surface 164 of the piston member 136. Flow passageways 127 provide fluid flow passageways to a lower chamber 174 formed in the space between the rear end 99 of the front piece 71 and the juxtaposed lower end 176 of the flange 101. In the position of the pendulum assembly 64A as illustrated in FIG. 5, the volume of the main chamber 172 is substantially greater than the volume of the upper and lower chambers 166 and 174, respectively, so that substantially all of the oil within the elongate body member 12A is in the main chamber 172.

In operation, the core sample orientation tool 10A is coupled to an overshot 22A, with packer (not shown) in up-hole use or sinker bar in down-hole use, as shown in FIGS. 5 and 6. The tool 10A is inserted through the hollow drill rod and bit 27A in a bore hole 129A. In the up-hole applications, hydraulic pressure is applied to the packer to pump the tool 10A into position. In down-hole applications, a sinker bar is inserted between the apparatus 10A and the overshot 22A. The sinker bar length may be chosen such that the tool 10A, sinker bar and overshot 22A will latch into the core barrel position in the drill rod with the putty cup 18A protruding through the hollow drill bit. At the end of the bore hole 129A the hydraulic pressure on the packer, or pressure on the drill rod, or weight of the sinker bar activates the pendulum assembly 64A. The putty cup 18A receives an impression from the upper surface or face 31A of the core (rock) 33A whose orientation is desired, and the pendulum 70A seeks to attain "bottom" (rotate to a stable position) which occurs in off-vertical bore holes. The force applied to the tool 10A by hydraulic pressure applied to the packer or the bar weight telescopes or slides the pendulum assembly 64A downwardly within the elongate body member 12A allowing the scriber 126A to mark or scratch the scribe receiving cylinder 59A indicating the "down" or "up" directional reference, or other orientation, as desired. The downward movement of the pendulum assembly 64A within the elongate body member 12A is controlled by the internal hydraulic chambers 166, 172 and 174 allowing the pendulum 70A to gradually move downwardly and assume a stable position before a directional mark is made on the scribe receiving cylinder 59A, and assuring that accidental shocks during insertion of the tool 10A into the bore hole 129A do not cause false markings. As an external force is applied to the pendulum assembly 64A through the packer or bar weight, the spring 156, and advantageously the hydraulic fluid within the main chamber 172 resist the downward movement of the pendulum assembly 70A within the elongate body member 12A. These resisting means are eventually overcome as the piston member 136 moves downwardly forcing the oil simultaneously through the flow passageways 127 and 152 into expanding lower chamber 174 and expanding upper chamber 166, respectively, thereby providing a damping or cushioning action to the downward movement of the pendulum assembly 64A providing time for gradual damping movement and stabilization thereof. The downward limit of movement of the pendulum assembly 64A relative to the elongate body member 12A is controlled by the lower end 182 of the piston member 136 which abuts the upper end 134 of flange 101.

As with the tool 10 shown in FIG. 4, the putty cup 18A, and plug member 44A and scribe receiving cylinder 59A of the tool 10A may be removed from the tool 10A after removal from the bore hole 129A. This removed putty cup assembly may be used in the same way as explained with reference to FIG. 4.

It should be understood that although the present invention has been illustrated to indicate a "down" directional reference or down side of the core, as shown in FIGS. 3 and 4, and an "up" directional reference in FIGS. 5 and 6, other directional references can be provided with a slight loss in pendulum efficiency by mounting the scribe bar to indicate such other orientation of the core. Advantageously, smooth upper threaded surfaces may be provided on the interior of the elongate body member or sleeve so that the o-rings of the pendulum assembly are easily received in the elongate body member without damage.

It should be understood by those skilled in the art that various modifications may be made in the present invention, without departing from the spirit and scope thereof as described in the specification and defined in the appended claims.

What is claimed is:

1. A core sample orientation tool for use in obtaining core impressions in bore holes, comprising:

an elongate body member having an upper end and a lower end, said upper end including a coupling member adapted to be mechanically coupled to a bore hole extension member;

a putty cup means mechanically coupled to said elongate body member at its lower end for obtaining a core impression in the bore hole;

pendulum means positioned within said elongate body member for movement to a stable orientation in the bore hole corresponding to the orientation of the core whose impression is to be taken;

marking means mechanically coupled to said pendulum means for movement in response to movement of said pendulum means, said pendulum means and marking means being mounted within said elongated body member for movement relative thereto; and mark receiving means arranged within said elongate body member in a fixed orientation relative to putty cup means for receiving a mark from said marking means after said pendulum means has assumed a stable orientation.

2. The core sample orientation tool claimed in claim 1, wherein:

said pendulum means includes an eccentric weight mounted for rotation about the longitudinal axis of said elongate body member.

3. The core sample orientation tool claimed in claim 1, wherein:

said pendulum means and said marking means are fixedly coupled to a rotatable shaft, so that movement of said pendulum means causes rotation of said rotatable shaft and said marking means fixedly coupled to said rotatable shaft.

4. The core sample orientation tool claimed in claim 1, including:

movement limiting means for limiting the downward movement of said marking means.

5. The core sample orientation tool claimed in claim 1, wherein:

said putty cup means and said mark receiving means are removably coupled to said elongate body member and are removable therefrom as a unit.

6. The core sample orientation tool claimed in claim 1, including:

a spring operatively coupling said elongate body member to the bore hole extension member and biased to oppose the downward movement of said pendulum means and said marking means relative to said elongate body member.

7. The core sample orientation tool claimed in claim 1, including:

a sleeve slidably arranged within said elongate body member for sealingly housing said pendulum means.

8. The core sample orientation tool claimed in claim 1, wherein:

said mark receiving means is formed in the shape of a cylinder and said marking means is a scribe capable of scribing a mark on said cylinder.

9. The core sample orientation tool claimed in claim 1, including:

hydraulic means for damping the downward movement of said pendulum means and said marking means relative to said elongate body member.

10. The core sample orientation tool claimed in claim 1, wherein:

said elongate body member includes an intermediate hydraulic chamber and upper and lower chambers in communication with said intermediate hydraulic chamber;

said intermediate hydraulic chamber including a piston means for reducing the volume of said intermediate hydraulic chamber in response to a force acting on said piston means to force hydraulic fluid out of said intermediate hydraulic chamber into said upper and lower chambers to provide time for damping and stabilization of said pendulum means and said marking means during downward movement thereof.

11. The core sample orientation tool claimed in claim 1, wherein:

said coupling member includes a rod having a threaded end adapted to be mechanically coupled to the bore hole extension member, said rod having a piston member fixedly coupled thereto, said piston member adapted for sliding movement within said elongate body member in response to downward force on said rod;

a flange spaced from said piston member to define a hydraulic chamber, said flange fixedly coupled to said elongate body member and adapted to slidably receive said rod therein;

biasing means operatively coupling said piston member to said flange for opposing the downward movement of said piston member;

passage means providing communication between the interior and exterior of said hydraulic chamber for expelling hydraulic fluid from said chamber upon downward movement of said piston member to control downward movement of said pendulum member and said marking means to enable said pendulum means and said marking means to stabilize prior to marking on said mark receiving means.

12. A core sample orientation tool for use in obtaining core impressions in bore holes, comprising:

a sleeve having upper and lower ends;

a putty cup removably connected to the lower end of said sleeve and capable of receiving a core impression from a bore hole;

a pendulum assembly slidably received within said sleeve, said pendulum assembly including coupling means adapted to receive a bore hole extension member;

marking means mechanically coupled to said pendulum assembly, said marking means being oriented by said pendulum assembly;

means for limiting the downward movement of said pendulum assembly and said marking means relative to said sleeve; and mark receiving means arranged in a fixed orientation relative to said putty cup for receiving a mark from said marking means indicating the limit of the downward movement of said pendulum assembly within said sleeve.

13. The core sample orientation tool claimed in claim 12, wherein:

said putty cup and said mark receiving means are removable as a unit from said sleeve.

14. The core sample orientation tool claimed in claim 12, wherein:

said downward movement limiting means includes projections coupled to said pendulum assembly and slots in said sleeve for receiving said projections, said projections and slots coacting to limit the downward movement of said pendulum assembly within said sleeve.

15. The core sample orientation tool claimed in claim 12, wherein:

said pendulum assembly includes a pendulum fixedly coupled to said marking means by a shaft journalled in bearings mounted in said pendulum assembly.

16. The core sample orientation tool claimed in claim 12, including:

biasing means for resisting the downward movement of said pendulum assembly.

17. The core sample orientation tool claimed in claim 12, including:

hydraulic damping means for controlling the downward movement of said pendulum assembly.

18. The core sample orientation tool claimed in claim 17, wherein:

said hydraulic damping means includes a flange fixedly coupled to said sleeve for slidably receiving said coupling means and a piston fixedly coupled to said coupling means within said sleeve and spaced from said flange, said flange and said piston defining a hydraulic chamber, said hydraulic chamber having at least one passageway for communicating between the interior and exterior thereof so that downward movement of the said piston forces hydraulic fluid through the passageway to control the downward movement of said pendulum assembly and said marking means to enable said pendulum assembly to assume a stable orientation prior to said marking means placing a mark on said mark receiving means.

19. The core sample orientation tool claimed in claim 18, including:

spring means coupled between said flange and said piston for resisting downward movement of said piston.

20. A core sample orientation tool adapted to be coupled to a bore hole extension member for taking core impressions in bore holes, comprising:

a sleeve having upper and lower ends;

a putty cup removably connected to the lower end of said sleeve for receiving a core impression when positioned in a bore hole;

a pendulum assembly slidably and sealingly received within said sleeve, said pendulum assembly including a pendulum mounted on a shaft journalled in bearings mounted in said pendulum assembly and a rod member extending outwardly from the upper end of said sleeve for coupling to a bore hole extension member;

scribing means mechanically coupled to said shaft for orientation by said pendulum;

means for limiting the downward movement of said pendulum assembly and said scribing means within said sleeve;

a scribe mark receiving cylinder mechanically coupled to said putty cup in a fixed orientation relative thereto for receiving a scribe mark from said scribing means indicating the limit of the downward movement of said pendulum assembly within said sleeve, said putty cup and said scribe mark receiving cylinder being removable as a unit from said sleeve; and biasing means for resisting the downward movement of said pendulum assembly within said sleeve.

21. A core sample orientation tool adapted to be coupled to a bore hole extension member for taking core impressions in bore holes, comprising:

a sleeve having upper and lower ends;

a putty cup removably connected to the lower end of said sleeve and capable of receiving a core impression when positioned in a bore hole;

a pendulum assembly slidably and sealingly received within said sleeve, said pendulum assembly including a pendulum mounted on a shaft journalled in bearings mounted in said pendulum assembly and a rod member extending outwardly from the upper end of the sleeve for coupling to a bore hole extension member;

scribing means mechanically coupled to said shaft for orientation by said pendulum;

means for limiting the downward movement of said pendulum assembly and therefore said scribing means within said sleeve;

a scribe mark receiving cylinder mechanically coupled to said putty cup in a fixed orientation relative thereto for receiving a scribe mark from said scribing means when said pendulum assembly is moved to the limit of its downward movement within said sleeve;

said putty cup and said scribe mark receiving cylinder being removable as a unit from said sleeve;

hydraulic damping means for controlling the downward movement of said pendulum assembly and said scribing means prior to scribing on said scribe mark receiving cylinder, said hydraulic damping means including a flange fixedly coupled to said sleeve for slidably receiving said rod member, a piston fixedly coupled to said rod member within said sleeve and spaced from said flange, said flange and said piston defining a hydraulic chamber, said hydraulic chamber having at least one passageway for communicating between the interior and exterior thereof so that upon downward movement of said piston hydraulic fluid is forced through the passageway to slow the downward movement of said pendulum assembly to enable said pendulum and said scribing means to assume a stable orientation prior to said scribing means placing a mark on said scribe mark receiving cylinder; and biasing means for resisting the downward movement of said pendulum assembly within said sleeve.

22. The core sample orientation tool claimed in claim 21, wherein:

said means for limiting the downward movement includes said flange and said piston, said piston upon downward movement abutting against said flange to provide the downward limit.

* * * * *